United States Patent [19]

Coates

[11] Patent Number: 4,989,576

[45] Date of Patent: Feb. 5, 1991

[54] INTERNAL COMBUSTION ENGINE

[76] Inventor: George J. Coates, 194 Belgard Heights, Belgard, County Dublin, Ireland

[21] Appl. No.: 401,631

[22] Filed: Jul. 26, 1982

[30] Foreign Application Priority Data

| | | | |
|---|---|---|---|
| Jul. 30, 1981 | [IE] | Ireland | 1742/81 |
| Mar. 3, 1982 | [IE] | Ireland | 483/82 |
| Apr. 20, 1982 | [IE] | Ireland | 933/82 |

[51] Int. Cl.[5] ..... F01L 7/00

[52] U.S. Cl. ..... 123/80 D; 123/190 D

[58] Field of Search ..... 123/190 A, 190 B, 190 BD, 123/190 E, 190 D, 80 D, 80 BA

[56] References Cited

U.S. PATENT DOCUMENTS

| | | | |
|---|---|---|---|
| 1,080,892 | 12/1913 | Chandler | 123/190 A |
| 1,232,097 | 7/1917 | Schneider | 123/80 B |
| 1,347,978 | 7/1920 | Wehr | 123/190 R |
| 1,388,758 | 8/1921 | Rahmeyer | 123/190 BD |
| 1,775,581 | 9/1930 | Baer | 123/190 E |
| 1,868,301 | 7/1932 | Zeeman | 123/190 BD |
| 2,156,960 | 5/1939 | Baer | 123/190 E |
| 2,617,395 | 11/1952 | Haase | 123/41.69 |
| 2,895,459 | 7/1959 | Sbaiz | 123/190 BD |
| 3,893,483 | 7/1975 | Ackerman | 123/190 A |
| 3,945,364 | 3/1976 | Cook | 123/190 R |
| 4,010,727 | 3/1977 | Cross et al. | 123/190 B |
| 4,077,382 | 3/1978 | Gentile | 123/190 A |
| 4,116,189 | 9/1978 | Asaga | 123/190 BB |
| 4,198,946 | 4/1980 | Rassey | 123/190 E |

FOREIGN PATENT DOCUMENTS

| | | | |
|---|---|---|---|
| 10202 | 7/1928 | Australia | 123/190 A |
| 919378 | 9/1954 | Fed. Rep. of Germany . | |
| 16166 | of 1909 | United Kingdom | 123/190 BD |

*Primary Examiner*—David A. Okonsky
*Attorney, Agent, or Firm*—Clifford G. Frayne

[57] ABSTRACT

An internal combustion engine of the piston and cylinder type is provided. The conventional cylinder head is replaced by a detachable head assembled from two hollowed out cylinder head components one of which (*3a*) is shown. The components when assembled provide a cavity (4) which is contoured so as to accommodate in gas-tight sealing with the walls thereof a rotor (5) having a pair of drums (7, 8) thereon, each drum (7, 8) has a rotor passage (*7a, 8a*) thereon so that when the rotor (5) is rotated (in a conventional manner), the rotor passages (*7a, 8a*) provide an uninterrupted conduit between the carburetor and the cylinder or the cylinder and the exhaust manifold during the induction stroke and the exhaust stroke respectively of the piston of one cylinder of the engine. Four pairs of drums are provided on the same rotor for use in a four cylinder, four stroke engine. Each drum (7, 8) has a spherical section (130) defined by two parallel planes (131, 132) of a sphere the planes being disposed symmetrically about the center of the sphere, and the intersection between the planes and the spherical section being rounded off.

24 Claims, 8 Drawing Sheets

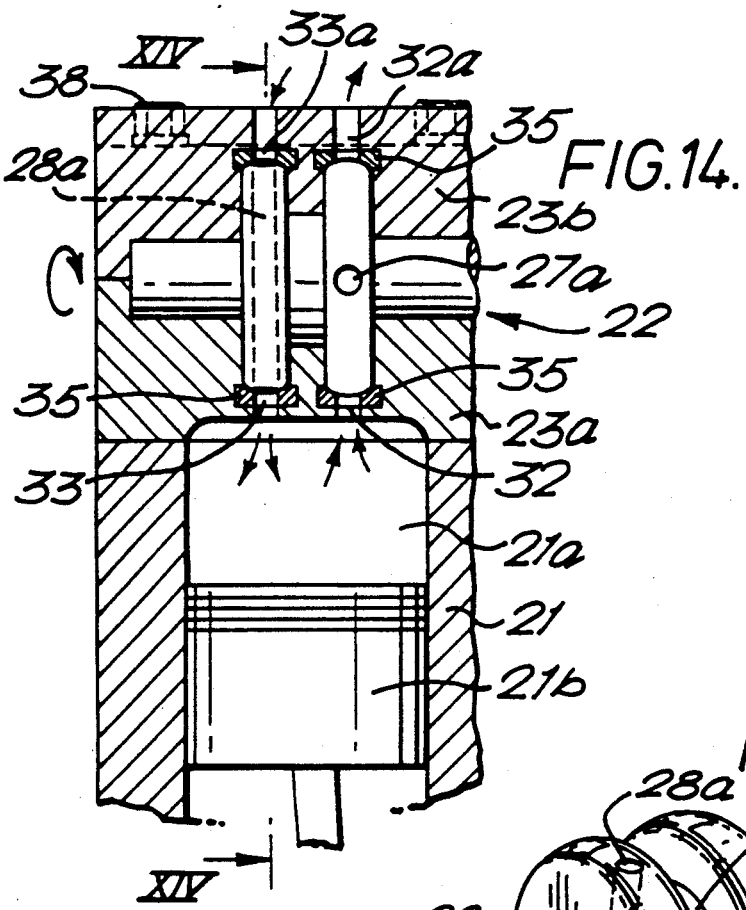
FIG.14.
FIG.15.
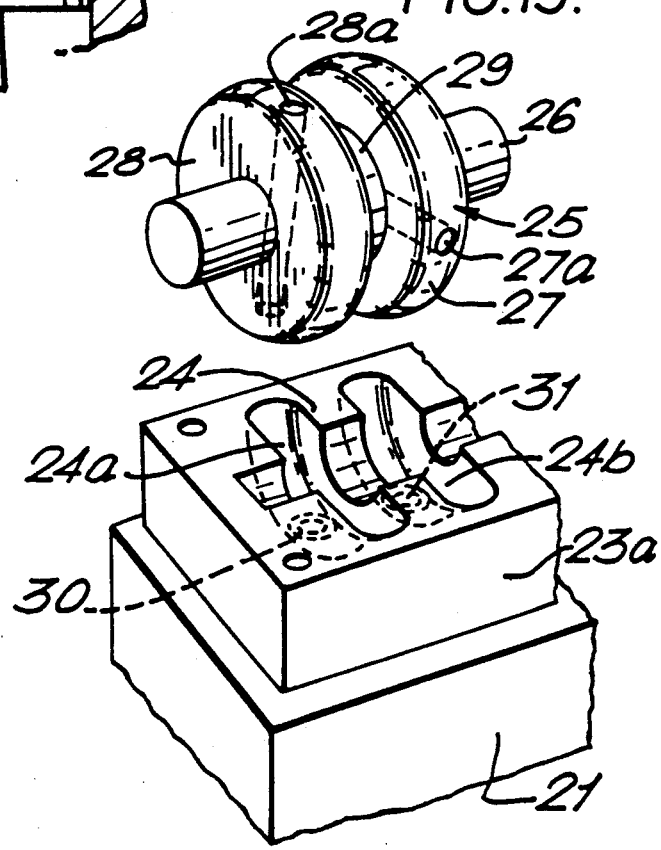

INTERNAL COMBUSTION ENGINE

BACKGROUND OF THE INVENTION

1. Field of the Invention

This invention relates to an internal combustion engine of the piston and cylinder type.

2. Description of Background Art

In an internal combustion engine of the piston and cylinder type, it is necessary to charge the cylinder with fuel for the combustion cycle and to vent the exhaust gases at the exhaust cycle of each cylinder of the engine. In a four-stroke engine, for example, the rotation of a camshaft causes a spring loaded valve to open to enable fuel to flow from the carburettor to the cylinder during the induction stroke. Similarly, at the exhaust stroke, the camshaft causes another spring loaded valve to open to enable exhaust gases to flow from the cylinder to the exhaust manifold.

The associated hardware for the efficient operation of the spring loaded valves includes items such as springs, cotters, guides, rocker shafts etc., all of which undergo stress when the engine is in operation and thus requires frequent servicing and maintenance if the engine is to operate at its optimum performance level. Furthermore, in a four-stroke engine having four cylinders, a total of eight spring loaded valves are in use, each valve having its own set of associated hardware.

SUMMARY AND OBJECTS OF THE INVENTION

It is an object of the present invention to provide an alternative means for allowing the fuel mixture for an internal combustion engine of the cylinder and piston type to flow to a cylinder of the engine and for venting the exhaust gases from the cylinder to the exhaust manifold.

The invention therefore provides in an internal combustion engine of the piston and cylinder type the improvement which comprises:

a detachable cylinder head assembled from two hollowed-out components to provide a cavity having radial symmetry within the cylinder head and wherein the cavity is divided into a first and a second drum-accommodating section for each cylinder of the engine;

a first passage for fuel mixture traversing said cylinder head by way of said first drum-accommodating section;

a second passage for exhaust gases traversing said cylinder head by way of said second drum-accommodating section;

a rotor journalled in said cylinder head, said rotor comprising a shaft having a first and a second drum for each cylinder of the engine coaxial thereon, each drum having a spherical section defined by two parallel planes of a sphere, the planes being disposed symmetrically about the centre of the sphere, the intersection between the planes and the spherical section being rounded off; each drum having a rotor passage;

when in position, said rotor occupies said cavity in gas-tight sealing contact with the walls of the cylinder head so that the first and second drum-accommodating sections are in gas-tight sealing isolation from each other; the first drum interrupts the first passage; the second drum interrupts the second passage; and means is provided for rotating the rotor at a speed related to the operating cycle of the engine so that the rotor passage of the first drum makes successive contact with the ends of the interrupted first passage to transfer successive charges of fuel mixture to the cylinder during rotation of the rotor and the rotor passage of the seocnd drum makes successive contact with the ends of the interrupted second passage to transfer successive charges of exhaust gases from the cylinder during rotation of the rotor.

Such an engine will be hereinafter referred to as an engine of the type described.

Thus, for example, the rotor passage of the first drum brings a charge of fuel mixture into communication with the cylinder during the induction stroke of the piston and continues on its rotary way still full of fuel mixture at a reduced pressure.

The rotor passage of the second drum receives a charge of compressed exhaust gases from the cylinder during the exhaust stroke of the piston, and continues on its rotary way until it makes a connection with a discharge port, where the charge is evacuated by decompression.

Preferably, the rotor passage of the first drum provides an uninterrupted conduit between a carburettor and the cylinder during the induction stroke of the piston to enable the fuel mixture to flow (passively or by injection) from the carburettor to the cylinder, and the rotor passage continues on its rotary way.

The rotor passage of the second drum provides an uninterrupted conduit between the cylinder and an exhaust manifold during the exhaust stroke of the piston to enable exhaust gases to flow from the cylinder to the exhaust manifold, and the rotor passage continues on its rotary way.

Each rotor passage may be a surface recess in the rotor or may be a duct. Preferably, each duct is diametrically disposed in the rotor and most preferably, the ducts are displaced about the axis of rotation of the rotor by approximately 180°. Alternatively, each rotor passage may be a surface recess.

Preferably, each recess is substantially oval in plan and has a rounded bottom and is located on the spherical section of each drum so that the longer axis of the oval is parallel to the planes of the sphere and equidistant therefrom. The length of the longer axis of the recess of the second drum is preferably longer than the length of the axis of the recess of the first drum. The difference in length is preferably approximately 10 mm. Alternatively, the volume of the recess of the second drum may be greater than the volume of the recess of the first drum.

Preferably, the recess of the first drum is displaced about the axis of rotation of the rotor by approximately 180° relative to the recess of the second drum.

Preferably, the first passage comprises a fuel inlet passage from the carburettor to the first drum-accommodating section and a fuel outlet passage from the first drum-accommodating section to the cylinder; and the second passage comprises an exhaust inlet passage from the cylinder to the second drum-accommodating section and an exhaust outlet passage from the second drum-accommodating section to the exhaust manifold.

The fuel inlet passage may be divided into a first and a second fuel inlet passage and the exhaust passage may be divided into a first and a second exhaust outlet passage.

Thus the recess of the first drum provides an uninterrupted conduit between the carburettor, the first fuel inlet passage, the second fuel inlet passage and the fuel outlet passage during the induction stroke of the piston; and the recess of the second drum provides an uninterrupted conduit between the exhaust inlet passage, the first exhaust outlet passage and the second exhaust outlet passage during the exhaust stroke of the piston.

The invention further provides at least one seal to improve the gas-tight sealing contact of the rotor with the cavity in the region of the intersection of the ends of the fuel outlet passage and/or the exhaust inlet passage with the cavity, which seal comprises an annular axially slidable element for lining said region in gas-tight sealing fashion, said element having an annular curved surface adapted for gas-tight sealing contact with the rotor, and means for biassing the annular surface against the rotor.

Preferably, the annular axially slidable element comprises a parallel-sided portion of a constant cross-sectional area, and a non-parallel-sided portion of increasing cross-sectional area which terminates in said annular curved surface.

The seal may be made from graphite steel in which case, the biassing means preferably comprises a spring adapted to engage the surface of the seal substantially opposite the curved surface.

In addition, the second drum-accommodating section may have a channel therein which channel runs from the region of, but is not in communication with, the exhaust inlet passage to the or each exhaust outlet passage so that, in use, when the recess of the second drum is in communication with the exhaust inlet passage, exhaust gases are permitted to exit from the cylinder through the channel to the or each exhaust outlet passage.

In order to assist in the cooling of the head during the operation of the engine, fins and/or fluid cooling ducts may be provided in the head. The fluid used is preferably water and is pumped in a conventional manner through ducts in the cylinder head. It will also be appreciated that to assist the rotation of the shaft, appropriate oil ducts or channels may be provided.

BRIEF DESCRIPTION OF THE DRAWINGS

The invention will be understood in greater detail from the following description of particular embodiments thereof given by way of example only with reference to the accompanying drawings in which:

FIG. 14 is a longitudinal sectional view of one cylinder of a fourth embodiment of an internal combustion engine according to the invention;

FIG. 15 is a perspective cut-away view of the internal combustion engine of FIG. 14;

DETAILED DESCRIPTION OF THE INVENTION

Figure 1:
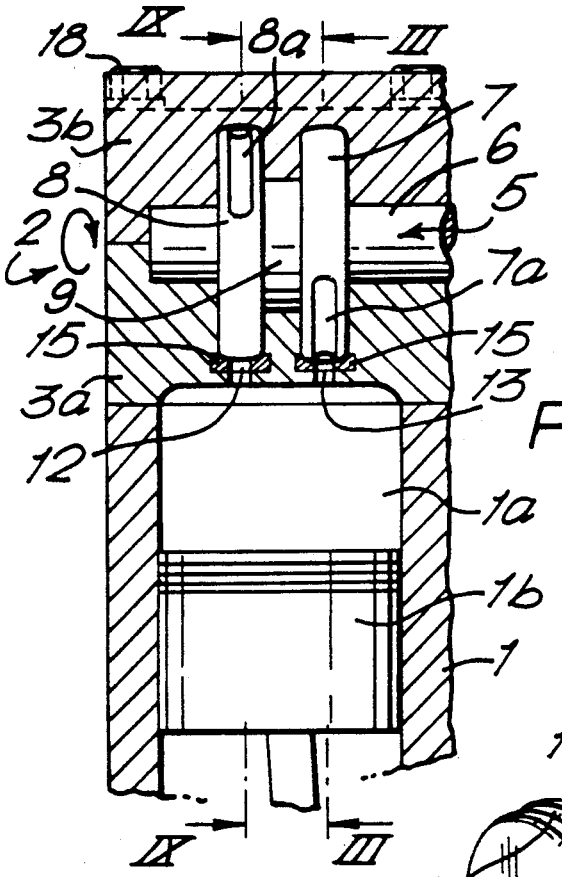
FIG. 1 is a longitudinal sectional view of one cylinder of a first embodiment of an internal combustion engine according to the invention.
Figure 2:
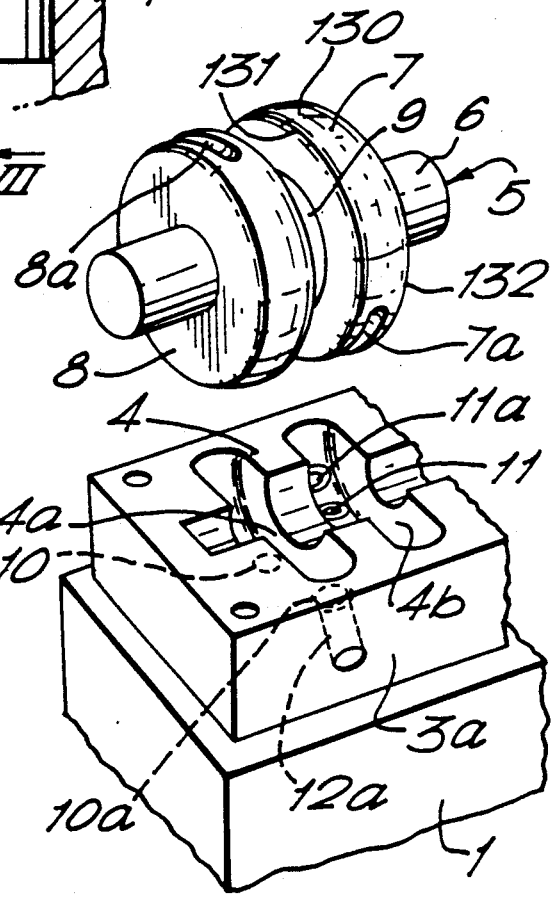
FIG. 2 is a perspective cut-away view of the internal combustion engine of FIG. 1.
Figure 3:
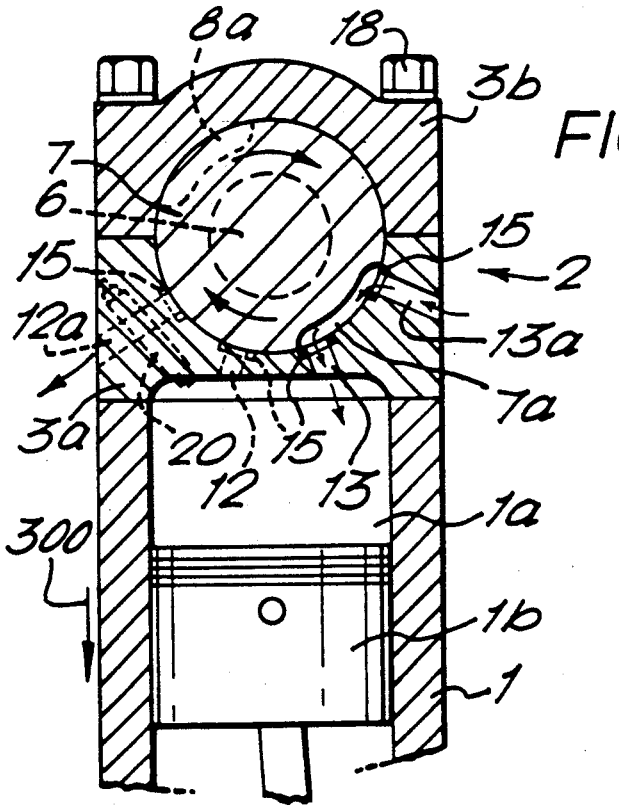
FIG. 3 is a cross-sectional view of the engine of FIG. 1 taken along the lines III—III and viewed in the direction of the arrows.

Referring now to FIGS. 1, 2 and 3 of the drawings, there is provided a cylinder block 1 having a cylinder 1*a* and a piston 1*b*, and a detachable cylinder head 2 which is assembled from two hollowed-out cylinder head components 3*a* and 3*b*. The two components 3*a* and 3*b* when assembled together provide a cavity half of which cavity 4 is shown in FIG. 2.

The cavity 4 has radial symmetry within the cylinder head 2 and is contoured so as to accommodate in gas-tight sealing with the walls thereof a rotor 5 which is free to rotate in the cavity. The rotor 5 comprises a shaft 6 having a pair of drums 7 and 8 coaxial thereon. Each drum 7 and 8 comprises a spherical section 130 defined by two parallel planes 131,132 of a sphere the parallel planes 131,132 being disposed symmetrically about the centre of the sphere; the intersection between the planes and the spherical section 130 being rounded off. In addition, the drums 7 and 8 are in parallel spaced apart relationship with respect to their planes and are separated by a thicker shaft section 9 of the shaft 6. Each drum 7 and 8 has a recess 7*a* and 8*a* respectively the purpose of which will be explained below. The drums 7 and 8 are fixed to the shaft 6 so that the recesses 7*a* and 8*a* are displaced about the axis of rotation of the shaft 6 by approximately 180° as shown in FIGS. 1 and 3.

From FIG. 2 it will be appreciated that the cavity 4 is divided into two drum-accommodating sections 4*a* and 4*b* which, when the rotor is in position together with the cylinder head component 3*b*, are in gas-tight isolation from each other. Each section 4*a* and 4*b* has a pair of ports 10, 10*a* and 11, 11*a* respectively. Each port 10, 10*a*, 11 and 11*a* leads into a respective passage. The port 10 leads into an exhaust inlet passage 12 from the cylinder 1*a* to the drum-accommodating 4*a*.

The port 10*a* leads into an exhaust outlet passage 12*a* from the drum-accommodating section 4*a*. Similarly, the port 11*a* leads into a fuel inlet passage 13*a* to the drum-accommodating section 4*b*. The port 11 leads into a fuel outlet passage 13 from the drum-accommodating section 4*a* to the cylinder 1*a*. The passages 12, 12*a*, 13 and 13*a* extend radially within the cylinder head component 3*a*. The passages 12 and 13 open into the cylinder 1*a* and the passages 12*a* and 13*a* open to the exhaust manifold (not shown) and the carburettor (not shown) respectively.

Surrounding the ports 10, 10*a*, 11, and 11*a* are seals 15 such as graphite seals on which the spherical sections of the drums 7 and 8 are cushioned when the cylinder head is assembled. The spherical sections of the drums 7 and 8 when in rotation are cushioned by the seals 15 in a manner similar to ball bearings in rotation on a similar seal. Thus, the seals 15 are positioned with respect to the spherical sections so that upon rotation of the drums 7 and 8, the seals 15 rotate slowly in a plane perpendicular to the plane of rotation of the drums to permit even wear thereon.

A conventional sparking plug 20 (shown in dotted outline in FIG. 2) is retained in the cylinder head component 3*a*. The cylinder head components 3*a* and 3*b* together with the rotor 5 are assembled as shown in the drawings and placed on top of a conventional cylinder in place of the conventional cylinder block 1. The entire assembly is held together in a conventional manner by head bolts 18.

It will be appreciated that what has been described above is in respect to just one cylinder of, for example, a four cylinder engine and by extending the shaft 6 and providing appropriate drums thereon, any number of cylinders may be accommodated.

To assist in the cooling of the cylinder block 1 during the operation of the engine, fins (not shown) may be provided on the upper part of the component 3*b*. In addition or alternatively, air or water ducts (not shown) may be present in the components 3*a* and/or 3*b* through which air or water may be circulated in a conventional manner. Care must be taken to ensure that the ducts referred to do not communicate with the passages 12, 12*a*, 13 or 13*a*.

Furthermore, by providing oil ducts (not shown) in the components 3*a* and 3*b* in the vicinity of the shaft 6 and the thicker shaft section 9, the friction of rotation of the rotor will be reduced considerably.

The oil ducts preferably comprise channels in the components 3*a* and 3*b* so that when the components are assembled, oil in the channels will form a film around the shaft 6 and the thicker shaft section 9. The oil may be pumped in a conventional manner.

In use, the shaft rotates in the direction of the arrows (as shown in FIGS. 1 and 3). The rotation of the shaft 6 is achieved in a conventional manner either by a starter motor (if the engine is not in operation) or by a flywheel (if the engine is in operation).

It will be seen that the recess 7*a* (see FIG. 3) provides an uninterrupted conduit between the carburettor and the cylinder 1*a* when the rotor 5 is in the position shown in FIG. 2. This represents the induction stroke of the piston and is equivalent to the opening of the inlet spring valve of a conventional engine. Following the induction stroke (shown by the arrow 300), the rotor 5 continues to rotate and thus the passages 13 and 13*a* are closed. The compression stroke follows, the rotor continues to rotate and the passages 13 and 13*a* remain closed. The passages 13 and 13*a* are closed at the exhaust stroke and the cycle repeats itself again at the commencement of the induction stroke. Thus, one revolution of the rotor 5 occurs for every four strokes of the piston of a four-stroke engine.

A similar event occurs with respect to the recess a except that the recess 8*a* provides a continuous conduit between the passages 12 and 12*a* for the exhaust gases at the exhaust stroke Because of the location of the recesses with respect to each other, at least one conduit is provided for every half revolution of the rotor 5.

Figure 4:
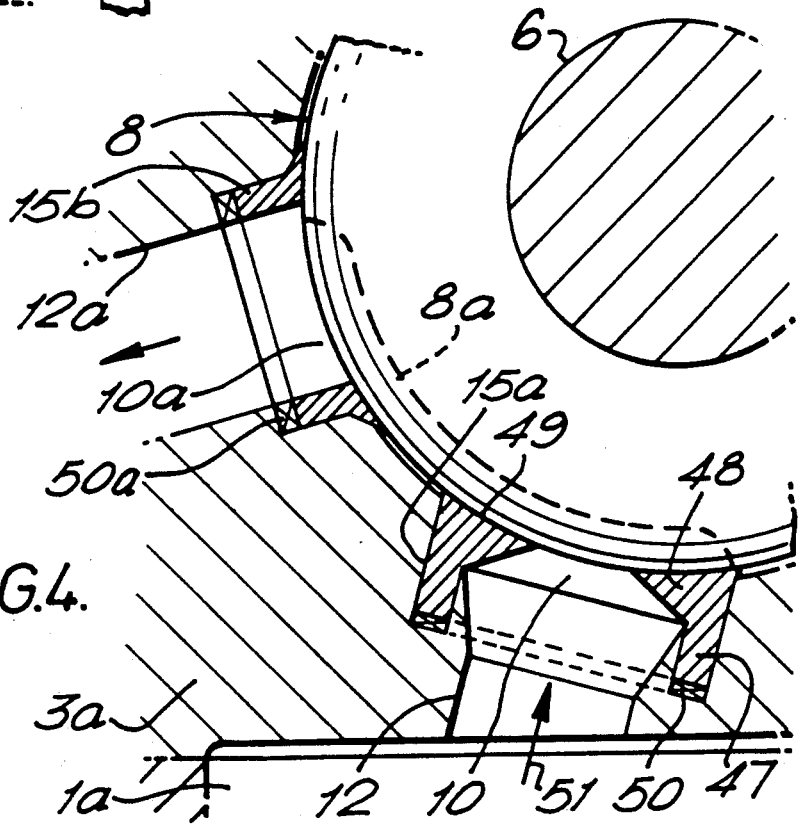
FIG. 4 is an enlarged view of a portion of the engine of FIG. 3.
Figure 5:
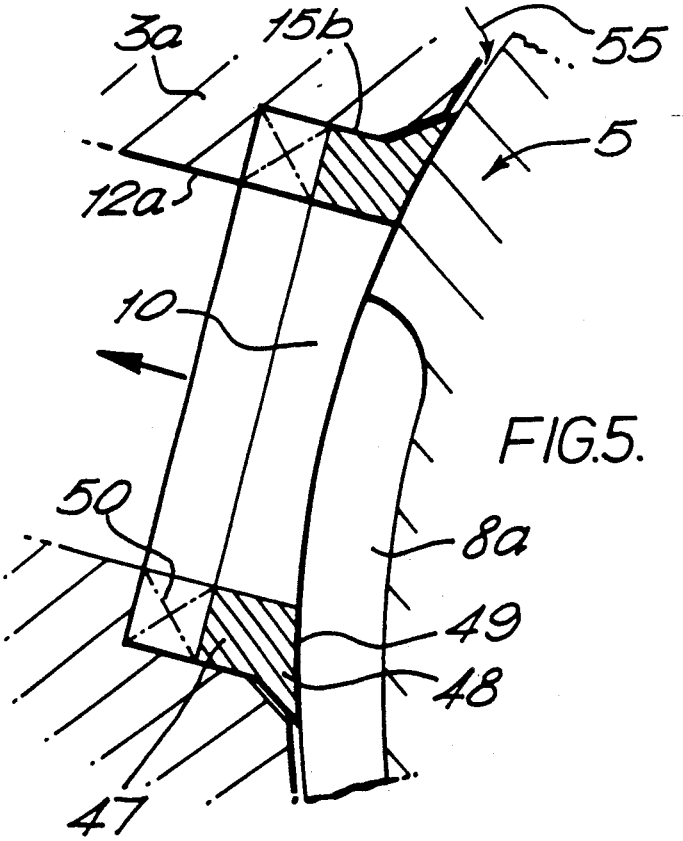
FIG. 5 is enlarged detail of the engine of FIG. 4.
Figure 6:
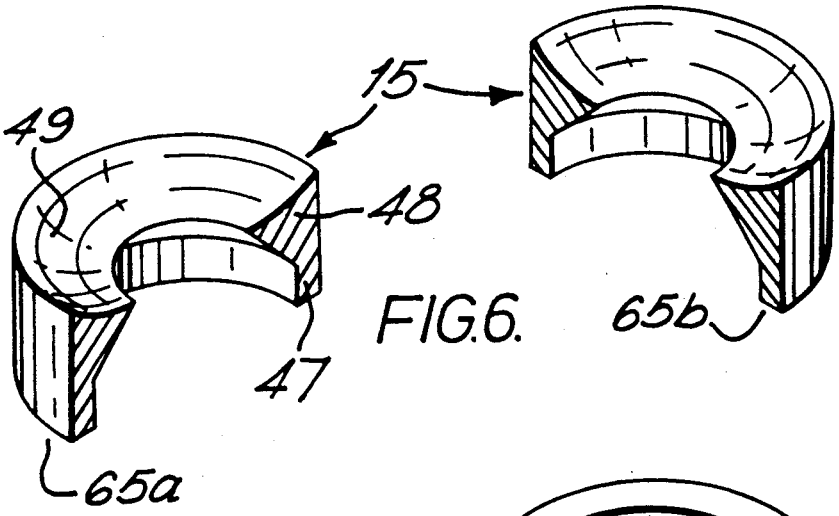
FIG. 6 is a perspective view of a first seal for use in the invention shown in two sections.

Referring now to FIGS. 4, 5, 6, and 7. In FIG. 4, which is an enlarged view of the recess 8*a* which has been rotated so as to provide an uninterrupted conduit between the cylinder 1*a* and the exhaust manifold during the exhaust stroke of the piston, there is shown the ports 10 and 10*a*, the passages 12 and 12*a*, the drum 8 and the recess 8*a*. Two different embodiments of the seals 15 are used viz 15*a* and 15*b*. In the case of the seal 15*a* which surrounds the port 10, reference should be made to FIG. 6. In FIG. 6 there is shown a seal 15 which for reasons of clarity is shown in two sections 65*a* and 65*b*. It will be appreciated that the seal 15 is manufactured as a single item. Referring in particular to 65*a*, the seal comprises a parallel-sided portion 47 of a constant cross-sectional area, and a non-parallel-sided portion 48 of increasing cross-sectional area. The portion 48 terminates in an annular curved surface 49 which is inward sloping and overhangs the opening of the annulus as shown in the drawings The seal is made of a graphite steel.

Referring back to FIG. 4 which shows the seal 15*a* in use, it will be seen that the seal 15*a* which surrounds the port 10 is inserted into a cavity in the component 3*a*. In the base of the cavity is a spring 50 which biasses the seal against the rotor 5. The annular curved surface 49 of the seal is contoured so as to intimately contact the surface of the drum 8. The seal 15*a* is not only biassed by the spring 50 into engagement with the drum 8. The exhaust gases (shown by the large arrow 51) are channeled by the seal configuration to the port 10 which exhaust gases serve to further bias the seal against the drum 8. In particular, at the moment of explosion of the fuel mixture in the cylinder, a considerable increase in gas pressure in the cylinder biasses the seal into engagement with the drum 8 at just the time when maximum gas-tight sealing between the rotor 5 and the component 3*a* is required.

Referring now to the seal 15*b* which surrounds the port 10*a* of FIG. 4 and also referring to FIG. 5 which shows an enlarged detail of the port 10*a* , the seal 15*b* also has a parallel-sided portion 47 of constant cross-sectional area and a non-parallel-sided portion 48 of increasing cross-sectional area. The part 48 terminates in an annular curved surface 49 which is inwardly sloping but, instead of overhanging the opening of the annulus as shown in seal 15*a*, flares away from the opening of the annulus and overhangs the outside periphery of the seal 15*b*.

In use the seal 15*b* is inserted into a cavity in the component 3*a* in a manner similar to the seal 15*a*. A spring 50*a* biasses the seal 15*b* into engagement with the drum 8. As with any rotor rotating within a block such as the cylinder head 2, there is inevitably a clearance between the rotor 5 and the cylinder head 2 shown by the arrow 55. In the case of the engine of the type referred to, this clearance is approximately 0.038 mm. Thus any leakage of gases from the cylinder *a* will be channeled through the clearance 55 and will contact the flared portion of the seal 15*b*. This leakage will further serve to bias the seal into engagement with the rotor 5.

Figure 7:
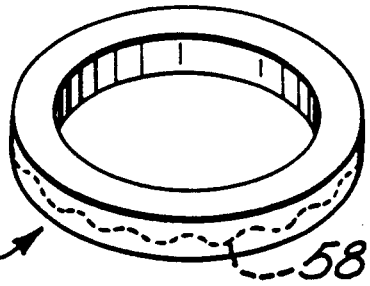
FIG. 7 is a perspective view of a second seal for use in the invention.

Referring now to FIG. 7, there is shown a seal 56 according to the invention which is made of rubber. The seal has an integral spring 58 in the wall thereof which spring serves to bias the seal into engagement with the surface which it is sealing.

Figure 8:
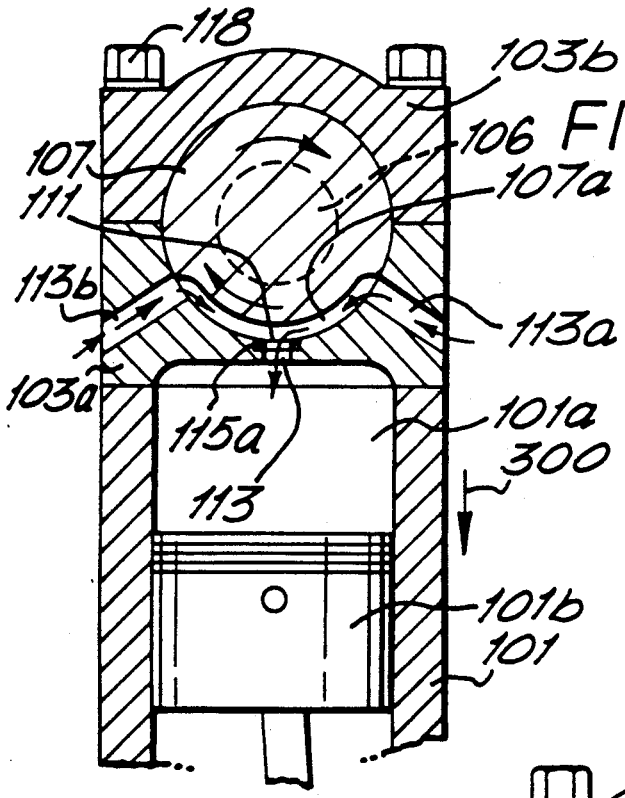
FIG. 8 is a cross-sectional view of a second embodiment of an internal combustion engine according to the invention, the view taken along similar lines to that shown with respect to FIG. 3.

Referring now to FIG. 8 of the drawings which figure is essentially similar to that shown and described with reference to FIG. 3 of the drawings.

In FIG. 8 there is shown a cylinder block 101 having a cylinder 101a and a piston 101b, and a detachable cylinder head 102 which is assembled from two hollowed-out cylinder head components 103a and 103b. The two components 103a and 103b when assembled together provide a cavity similar to that shown in FIG. 2.

As in FIG. 3 there is provided a rotor having a shaft 106 and a drum 107 having a recess 107a corresponding with shaft 6, drum 7 and recess 7a of FIG. 3. The essential difference between FIG. 8 and FIG. 3 is that instead of one passage 13a as shown in FIG. 3, there are two passages 113a and 113b provided in the component 103a.

The passages 113a and 113b open to either a common carburettor or a respective carburettor (not shown). A passage 113 corresponds with the passage 13 of FIG. 3 and the passages 113, 113a and 113b extend radially within the cylinder head component 103a. The recess 107a corresponds with the recess 7a of FIG. 3 and it will be appreciated that the recess 107a provides an uninterrupted conduit between the carburettor and the cylinder 101a when the rotor 105 is in the position shown in FIG. 8. This represents the induction stroke (represented by the arrow 300) of the piston and the availability of two passages 113a and 113b enables a greater volume of fuel mixture to enter the cylinder 101a when compared with the embodiment described with respect to FIG. 3. A seal 115a (corresponding with seal 15a of FIG. 4) is provided at the port 111 (which corresponds with the port 11 of FIG. 2) of the passage 113. It will be further appreciated that, two passages (not shown) equivalent to passages 113a and 113b may be provided to enable exhaust gases to be discharged during the exhaust stroke of the piston. The use of twin exhaust passages has been found to increase the overall performance of the engine according to the invention.

Figure 9:
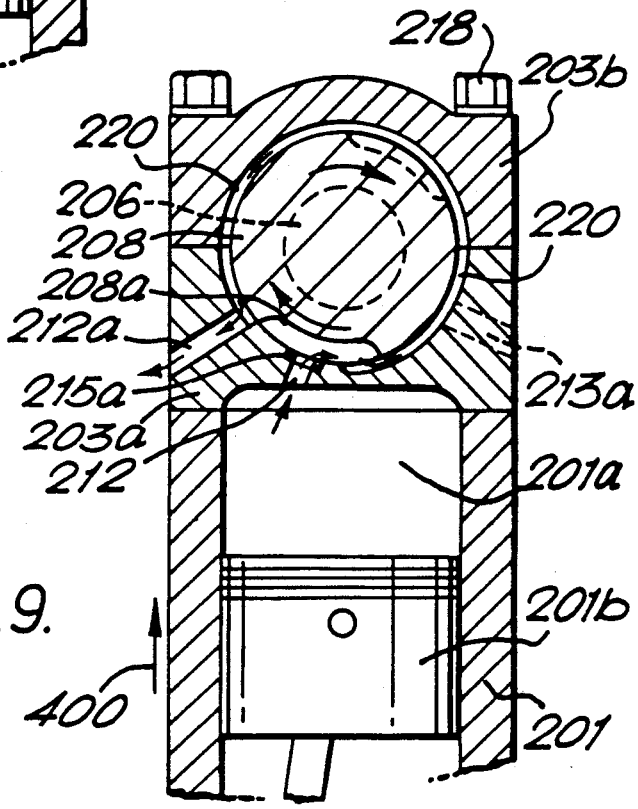
FIG. 9 is a cross-sectional view of a third embodiment of an internal combustion engine according to the invention, the view taken along the line IX—IX of FIG. 1 and viewed in the direction of the arrows.

Referring now to FIG. 9 of the drawings, (which figure is essentially similar to that shown and described with respect to FIG. 3 except that the view is taken along the line IX—IX of FIG. 1 and viewed in the direction of the associated arrows), the components of FIG. 3 are shown namely:

a cylinder block 201 having a cylinder 201a and a piston 201b and a detachable cylinder head 202 which is assembled from two hollowed-out cylinder head components 203a and 203b. The two components 203a and 203b when assembled together provide a cavity similar to that shown in FIG. 2. There is also provided a rotor having a shaft 206 and a drum 208 having a recess 208a corresponding with shaft 6, drum 8 and recess 8a of FIG. 3.

FIG. 9 shows the piston 201b during the exhaust stroke (represented by the arrow 400) of the engine and the essential difference between FIG. 9 and FIG. 3 is that in FIG. 9, there is provided a channel 220 in the components 203a and 203b. The channel 220 runs from the vicinity of the seal 215a around the wall of the drum-accommodating section 104b and is in communication with the exhaust passage 212a. Furthermore, the rotor has been rotated so that the recess 208a is in communication with the passage 212.

As can be seen from FIG. 9, the recess 208a is also in communication with the channel 220 and even though the recess 208a is not yet directly in communication with the passage 212a which leads to an exhaust manifold (not shown), exhaust gases from the cylinder are permitted to exit to the passage 212a via the channel 220 in a direction opposite to the direction of rotation of the shaft as shown by the arrows in the channel 220. It will be appreciated that the channel 220 must not be in direct communication with the passage 212 and must be in direct communication with the passage 212a.

Thus, the channel 220 is functioning as an extension of the passage 212a so as to permit exhaust gases to escape from the cylinder 201a earlier in the cycle of the piston 201b when compared with the cycle of FIG. 3. A seal must not be used and it is not required in the vicinity of the passage 212a. It has been found that the provision of the channel 220 improves the overall performance of the internal combustion engine.

Figure 10:
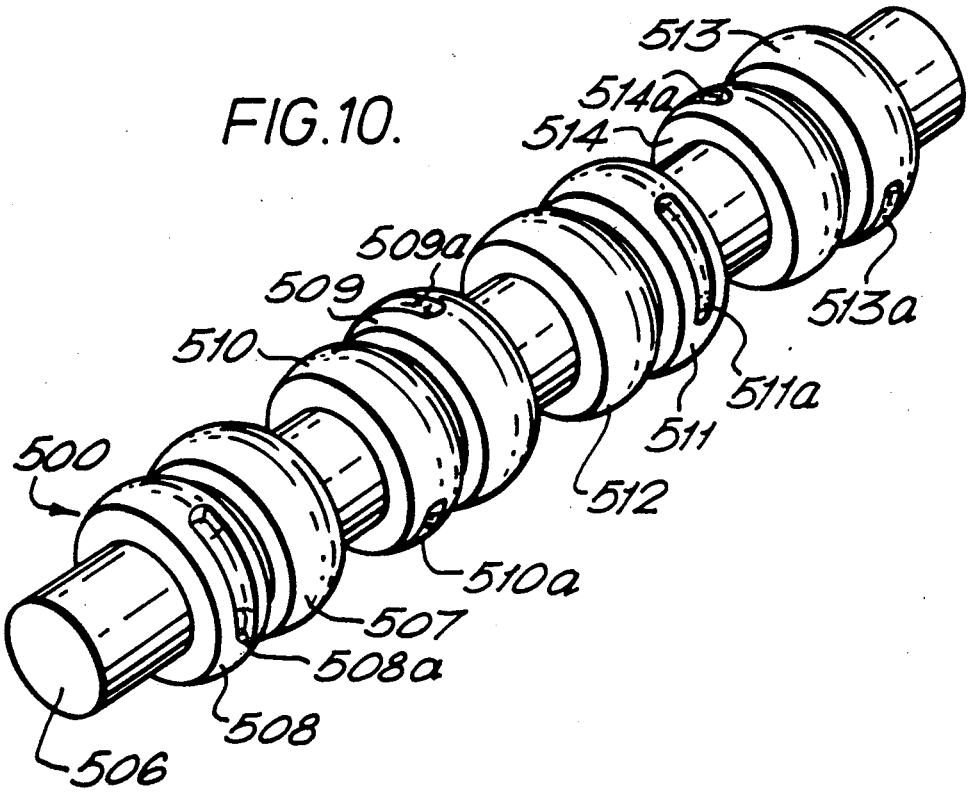
FIG. 10 is a perspective view of a first embodiment of a rotor for use in the internal combustion engines of FIGS. 1–9.

Referring now to FIG. 10 of the drawings, there is shown a rotor 500 for use in a four cylinder four-stroke internal combustion engine according to the invention. The rotor 500 comprises a shaft 506 and four pairs of drums 507 and 508; 509 and 510; 511 and 512; and 513 and 514. Each pair of drums is associated with one cylinder of the engine and correspond with the drums 7 and 8 of FIGS. 1–3. Each drum has a recess located on the respective spherical section of the drums of the rotor. Thus, the drums 508, 510 and 514 have respective recesses 508a, 510a and 514a (the recess of drum 512 is not visible). Similarly, the drums 509, 511 and 513 have respective recesses 509a, 511a and 513a (the recess of drum 507 is not visible) are not visible.

To take cognizance of the operating cycle of the four pistons of the engine, each pair of drums is mounted on the shaft 506 with their recesses located relative to each other as follows:

Taking the recess 508a to be at 0° relative to the shaft 506, the recess 510a, the recess of drum 512 and the recess 514a are located at approximately 90°, 180° and 270° respectively on the shaft. Similarly, the recesses of the drums 507, and the recesses 509a, 511a and 513a are located on their respective drums at 180°, 270° and 0° and 90° relative to the recess 508a.

Figure 11:
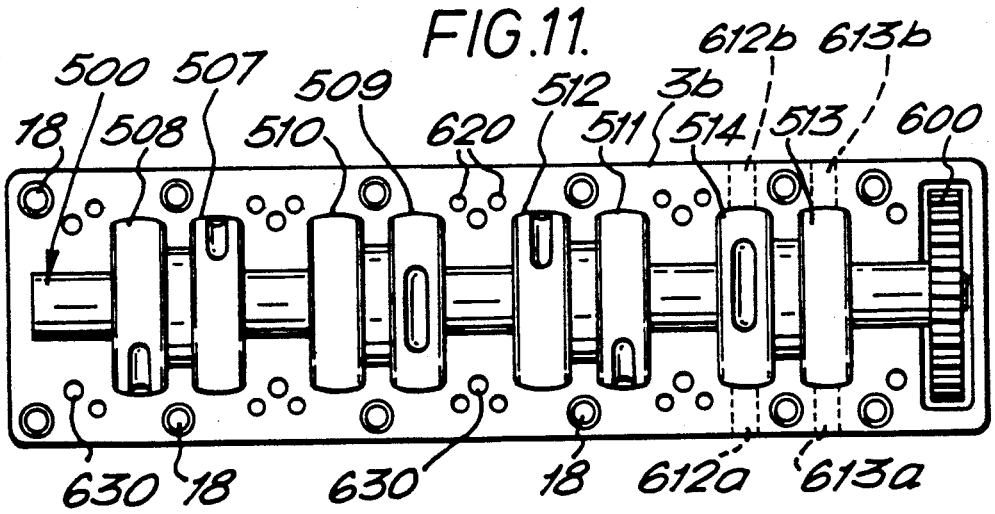
FIG. 11 is a plan view of the cylinder head of the internal combustion engine of FIGS. 1–10.

Referring now to FIG. 11 of the drawing, there is shown a plan view of the cylinder head of an internal combustion engine showing the rotor 500 of FIG. 10 in position. Shown in the drawing is the component 3b, head bolts 18 and a drive wheel 600 for rotating the rotor 500. Also shown are the drums 507–514 and their respective recesses (where visible) 507a to 514a. In addition, ducts 620 for water circulation for cooling the cylinder head are shown as well as oil ducts 630 for lubricating the shaft 500. Represented in dotted outline associated with the pair of drums 513 and 514 are passages 613a and 613b which correspond with the passages 113a and 113b of FIG. 8. Twin exhaust outlet passages are also provided viz 612a and 612b.

Figure 12:
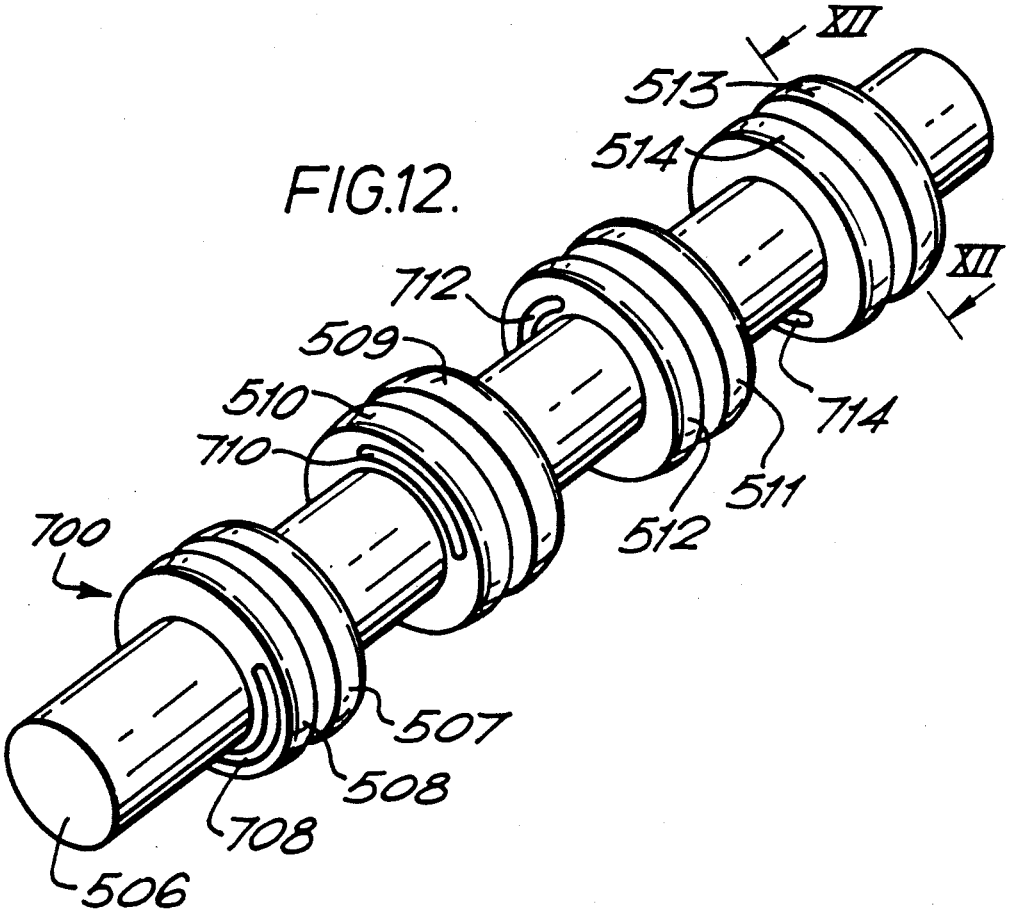
FIG. 12 is a perspective view of a second embodiment of a rotor for use in the internal combustion engine according to the invention.
Figure 13:
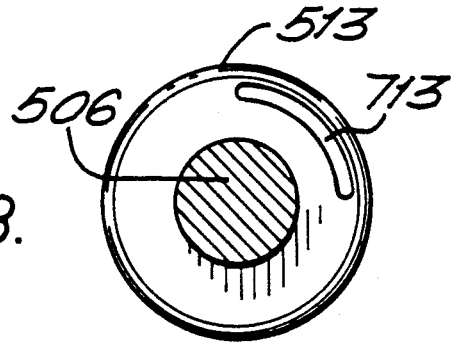
FIG. 13 is a cross-sectional view of the rotor of FIG. 12 taken along the line XII—XII of that figure.

Referring now to FIGS. 12 and 13 of the drawings, there is shown a rotor 700 for use in a four cylinder four-stroke internal combustion engine according to the invention. The rotor is similar to the rotor described with respect to FIG. 10 of the drawings and like references are used for like components from FIG. 10. Instead of locating the respective recess of each drum on the spherical section of each drum as in FIG. 10, the recesses are located on one of the two parallel planes of the spherical section thereof said parallel plane being the plane remote from the adjacent drum. Thus, the equivalent recesses to the recess of FIG. 10 are shown respectively also as follows:

Recesses 508*a*, 510*a*, the recess of drum 512 and recess 514*a* of FIG. 10 correspond with recesses 708, 710, 712 and 714 of FIG. 12. The recesses of FIG. 12 corresponding with the recess of drum 507 and the recesses 509*a*, 511*a* and 513*a* of FIG. 10 are not visible in FIG. 12 but FIG. 13 shows a recess 713 corresponding with recess 513*a* of FIG. 10. As in FIG. 10, the recesses of the rotor 700 are located relative to each other in order to take cognizance of the operating cycle of the engine To enable the rotor 700 to function in a manner similar to that described with respect to the rotor of FIGS. 1, 2 and 3, the passages 12, 12*a*, 13 and 13*a* are located so as to be in register with the recesses of the rotor 700 at the appropriate time in the operating cycle of the the engine. As in FIGS. 1, 2 and 3, seals may also be provided to further improve the gas-tight sealing contact of the rotor with the cavity.

Figure 16:
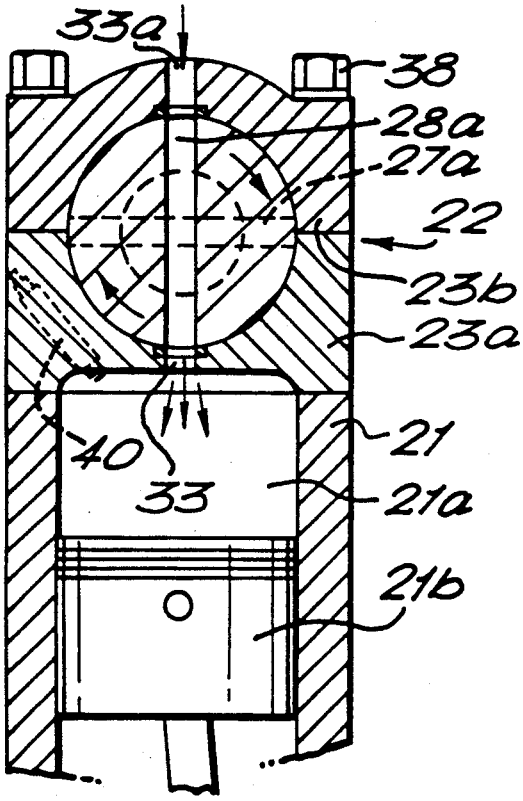
FIG. 16 is a cross-sectional view of the engine of FIG. 14 taken along the lines XIV—XIV of that figure and viewed in the direction of the arrows.

Referring now to FIGS. 14, 15 and 16 of the drawings, there is provided a cylinder block 21 having a cylinder 21*a* and a piston 21*b*, and a detachable cylinder head 22 which is assembled from two hollowed-out cylinder head components 23*a* and 23*b*. The two components 23*a* and 23*b* when assembled together provide a cavity half of which cavity 24 is shown in FIG. 15. The cavity 24 has radial symmetry within the cylinder head 22 and is contoured so as to accomodate in gas-tight sealing with the walls thereof a rotor 25 which is free to rotate in the cavity. The rotor 25 comprises a shaft 26 having a pair of drums 27 and 28 coaxial thereon. Each drum 27 and 28 comprises a spherical section defined by two parallel planes of a sphere, the parallel planes being disposed symmetrically about the centre of the sphere; the intersection between the planes and the spherical section being rounded off. In addition, the drums 27 and 28 are in parallel spaced apart relationship with respect to their planes and are separated by a thicker shaft section 9 of the shaft 26. Each drum 27 and 28 has a duct 27*a* and 28*a* respectively diametrically disposed on the rotor the purpose of which will be explained below. The drums 27 and 28 are fixed to the shaft 26 so that the ducts 27*a* and 28*a* are displaced about the axis of rotation of the shaft 26 by approximately 180°.

From FIG. 15 it will be appreciated that the cavity 24 is divided into two drum-accommodating sections 24*a* and 24*b* which, when the rotor is in position together with the cylinder head components 23*b*, are in gas-tight isolation from each other. Each section 24*a* and 24*b* has a port 30 and 31 respectively. Each port 30 and 31 leads into a respective passage. The port 30 leads into a cylinder inlet passage 33 and the port 31 leads into a cylinder exhaust passage 32. Similarly, from FIG. 16, the cylinder head component 23*b* also has a cavity having ports. Each port leads into a respective passage. One port leads into a cylinder head exhaust passage 32*a* and the other port leads into a cylinder head inlet passage 33*a*. The passages 32, 32*a*, 33 and 33*a* extend radially within the cylinder head components 23*a* and 23*b*. The passages 32 and 33 open into the cylinder 21*a* and the passages 32*a*and 33*a* open to the exhaust manifold (not shown) and the carburettor (not shown) respectively.

Surrounding the ports 30 and the ports in the cylinder head component 23*a* and 23*b* are seals 35 such as graphite seals on which the spherical head is assembled. The spherical sections of the drums 27 and 28 when in rotation are cushioned by the seals 35 in a manner similar to ball bearings in rotation on a similar seal. Thus, the seals 35 are positioned with respect to the spherical sections so that upon rotation of the drums 27 and 28, the seals 35 rotate slowly in a plane perpendicular to the plane of rotation of the drums to permit even wear thereon.

A conventional spark plug 40 (shown in dotted outline in FIG. 16) is retained in the cylinder head component 23*a*.

The cylinder head components 23*a* and 23*b* together with the rotor 25 are assembled as shown in the drawings and placed on top of a conventional cylinder in place of the conventional cylinder head. The entire assembly is held together in a conventional manner by head bolts 38.

It will be appreciated that what has been described above is in respect of just one cylinder of, for example, a four cylinder engine and by extending the shaft 26 and providing appropriate drums thereon, any number of cylinders may be accommodated In use, the shaft rotates in the direction of the arrows (as shown in FIGS. 14 and 16). The rotation of the shaft 26 is achieved in a conventional manner either by a starter motor (if the engine is not in operation) or by a flywheel (if the engine is in operation).

It will be seen that the duct 28*a* (see FIG. 16) provides an uninterrupted conduit between the carburettor and the cylinder 21*a* when the rotor 25 is in the position shown in FIG. 16. This represents the induction stroke of the piston and is equivalent to the opening of the inlet spring valve of a conventional engine. Following the induction stroke, the rotor 25 continues to rotate and thus the passages 33 and 33*a* are closed. The compression stroke follows, the rotor continues to rotate and the passages 33 and 33*a* remain closed. The passages 33 and 33*a* are closed at the exhaust stroke and the cycle repeats itself again at the commencement of the induction stroke. Thus, a half revolution of the rotor 25 occurs for every four strokes of the piston of a four-stroke engine.

A similar event occurs with respect to the duct 27*a* except that the duct 27 provides a continuous conduit between the passages 32 and 32*a* for the exhaust gases at the exhaust stroke Because of the location of the ducts with respect to each other, at least one conduit is provided for every quarter revolution of the rotor 25. The seals 35 are similar to those described with respect to FIGS. 4, 5, 6 and 7 of the drawings.

Figure 17:
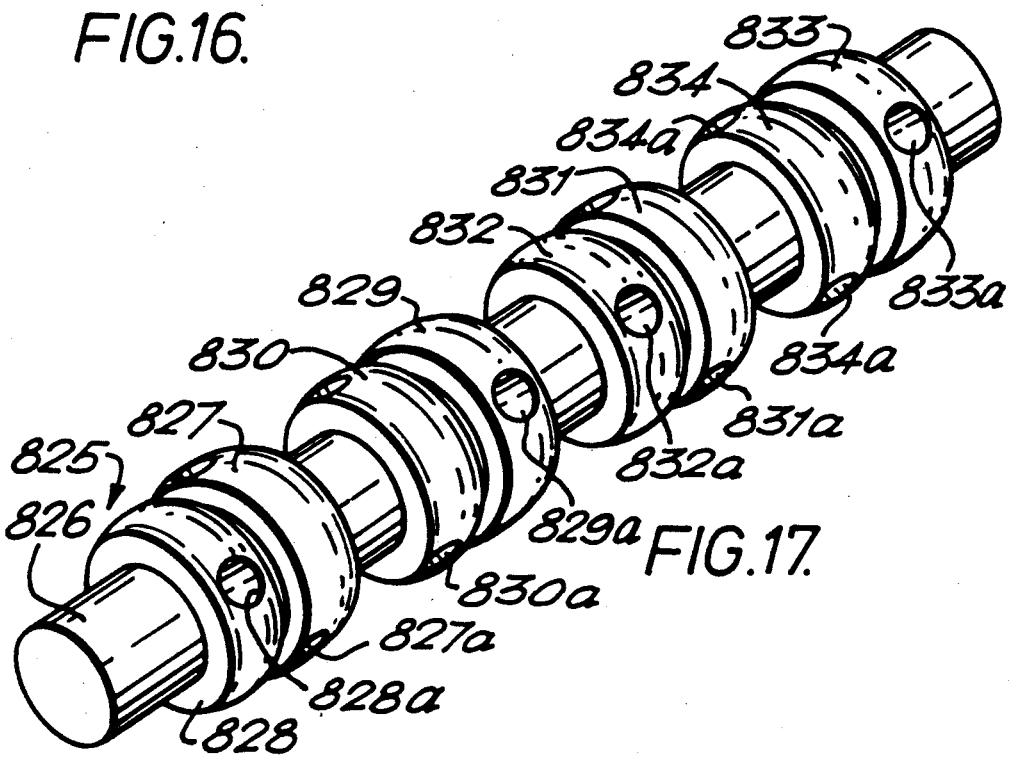
FIG. 17 is a third embodiment of a rotor for use in the internal combustion engine of FIGS. 14–16.

Referring now to FIG. 17 of the drawings which shows a rotor 825 for use in the internal combustion engine of FIGS. 14–16 having four cylinders. The rotor comprises a shaft 826 and four pairs of drums 827 and 828; 829 and 830; 831 and 832; and 833 and 834. Each pair of drums is associated with one cylinder of the engine and correspond with drums 27 and 28 of FIGS. 14–16. Each drum 827–834 has a respective duct diametrically located on the respective spherical section thereof. Thus the drums 827–834 respectively have ducts 827*a*–834*a* respectively. To take cognizance of the operating cycle of the four pistons of the engine, each pair of drums is mounted on the shaft 826 with their ducts located relative to each other as follows:

Taking the recess 828*a* to be at 0° relative to the shaft 826, the ducts 829*a*, 832*a* and 833*a* are also located at 0° whereas the remaining ducts are at 90° relative to the duct 828*a*. Thus, in a half revolution of the rotor 826 occurs for every four strokes of the piston of a four-stroke engine.

While the foregoing embodiments are at present considered to be preferred, it is understood that numerous variations and modifications may be made therein by those skilled in the art.

I claim:

1. In an internal combustion engine of the piston and cylinder type, the improvement which comprises:

a detachable cylinder head assembled from two hollowed-out components to provide a cavity having radial symmetry within the cylinder head and wherein the cavity is divided into a first and a second drum-accommodating section for each cylinder of the engine; a first passage for fuel mixture traversing said cylinder head by way of said first drum-accommodating section;

a second passage for exhaust gases traversing said cylinder head by way of said second drum-accommodating section;

a rotor journalled in said cylinder head, said rotor comprising a shaft having a first and a second drum for each cylinder of the engine coaxial thereon, each drum having a spherical section defined by two parallel planes of a sphere, the planes being disposed symmetrically about the centre of the sphere, the intersection between the planes and the spherical section being rounded off;

each drum having a surface recess thereon;

when in position, said rotor occupies said cavity in gas-tight sealing contact with the walls of the cylinder head so that the first and second drum-accommodating sections are in gas-tight sealing isolation from each other;

the first drum interrupts the first passage;

the second drum interrupts the second passage; and means is provided for rotating the rotor at a speed related to the operating cycle of the engine so that the surface recess of the first drum makes successive contact with the ends of the interrupted first passage to transfer successive charges of fuel mixture to the cylinder during rotation of the rotor and the surface recess of the second drum makes successive contact with the ends of the interrupted second passage to transfer successive charges of exhaust gases from the cylinder during rotation of the rotor.

2. An engine as claimed in claim 1 wherein the surface recess of the first drum brings a charge of fuel mixture into communication with the cylinder during the induction stroke of the piston and the surface recess of the second drum receives a charge of compressed exhaust gases from the cylinder during the exhaust stroke of the piston.

3. An engine as claimed in claim 1 wherein the surface recess of the first drum provides an uninterrupted conduit between the carburetor and the cylinder during the induction stroke of the piston to enable the fuel mixture to flow, passively or by injection, from the carburetor to the cylinder, and the surface recess of the second drum provides an uninterrupted conduit between the cylinder and the exhaust manifold during the exhaust stroke of the piston to enable exhaust gases to flow from the cylinder to the exhaust manifold.

4. An engine as claimed in claim 3 wherein each surface recess is substantially oval in plan and has a rounded bottom and is located on the spherical section of each drum so that the longer axis of the oval is parallel to the planes of the sphere and equidistant therefrom.

5. An engine as claimed in claim 3 wherein each surface recess is substantially oval in plan and has a rounded bottom as is located on one of the two parallel planes of the sphere of each drum so that the longer axis of the oval is parallel to the spherical section of the sphere.

6. An engine as claimed in claim 5 wherein the length of the longer axis of the surface recess of the second drum is approximately 10 mm longer than the length of the axis of the recess of the first drum.

7. An engine as claimed in claim 5 wherein the volume of the surface recess of the second drum is greater than the volume of the recess of the first drum.

8. An engine as claimed in claim 3 wherein the surface recess of the first drum is displaced about the axis of rotation of the rotor by approximately 180° relative to the recess of the second drum.

9. An engine as claimed in any one of claims 1–3 wherein each surface recess is a duct diametrically disposed in the rotor.

10. An engine as claimed in claim 3 wherein the first passage comprises a fuel inlet passage from a carburetor to the first drum-accommodating section and a fuel outlet passage from the first drum-accommodating section to the cylinder; and the second passage comprises an exhaust inlet passage from the cylinder to the second drum-accommodating section and an exhaust outlet passage from the second drum-accommodating section to the exhaust manifold.

11. An engine as claimed in claim 10 wherein the fuel inlet passage is divided into a first and a second fuel inlet passage and the exhaust passage is divided into a first and a second exhaust outlet passage.

12. An engine as claimed in claim 11 wherein the surface recess of the first drum provides an uninterrupted conduit between the carburettor, the first fuel inlet passage, the second fuel inlet passage and the fuel outlet passage during the induction stroke of the piston; and the surface recess of the second drum provides an uninterrupted conduit between the exhaust inlet passage, the first exhaust outlet passage and the second exhaust outlet passage during the exhaust stroke of the piston.

13. An engine as claimed in claim 3 which further comprises at least one seal to improve the gas-tight sealing contact of the rotor with the cavity in the region of the intersection of the ends of the fuel outlet passage and/or the exhaust inlet passage with the cavity, which seal comprises an annular axially slidable element for lining said region in gas-tight sealing fashion, said element having an annular curved surface adapted for gas-tight sealing contact with the rotor, and means for biasing the annular surface against the rotor.

14. An engine as claimed in claim 14 wherein the annular axially slidable element comprises a parallel-sided portion of a constant cross-sectional area, and a non-parellel-sided portion of increasing cross-sectional area which terminates in said annular curved surface.

15. An engine as claimed in claim 14 wherein the seal is made from graphite steel and the biasing means comprises a spring adapted to engage the surface of the seal substantially opposite the curved surface.

16. An engine as claimed in claim 14 wherein the second drum-accommodating section has a channel therein which channel runs from the region of, but is not in communication with, the exhaust inlet passage to the or each exhaust outlet passage so that, in use, when the surface recess of the second drum is in communication with the exhaust inlet passage, exhaust gases are permitted to exit from the cylinder through the channel to the or each exhaust outlet passage.

17. A rotor for use in an internal combustion engine as claimed in any one of claims 1–3 which rotor comprises a shaft having at least a first and a second drum for each cylinder of the engine coaxial thereon, each drum having a spherical section defined by two parallel planes of a sphere the planes being disposed symmetrically about the centre of the sphere, the intersection between the planes and the spherical section being rounded off and wherein each drum has a surface so that in use, the surface recess of the first drum makes successive contact with the ends of the interrupted first passage of the engine so as to transfer successive charges of fuel mixture to the cylinder of the engine during rotation of the rotor and the surface of the second drum makes successive contact with the ends of the interrupted second passage to transfer successive charges of exhaust gases from the cylinder during rotation of the rotor.

18. A rotor as claimed in claim 17 where the shaft comprises four pairs of first and second drums coaxial thereon for use with a four cylinder, four-stroke engine.

19. A rotor as claimed in claim 18 wherein each surface recess is substantially oval in plan and has a rounded bottom and is located on the spherical section of each drum so that the longer axis of the oval is parallel to the planes of the sphere and equidistant therefrom.

20. A rotor as claimed in claim 18 wherein each surface recess is substantially oval in plan and has a rounded bottom and is located on one of the two parallel planes of the sphere of each drum so that the longer axis of the oval is parallel to the spherical section of the sphere.

21. A rotor as claimed in claim 21 wherein the length of the longer axis of the surface recess of the second drum is approximately 10 mm longer than the length of the axis of the recess of the first drum.

22. A rotor as claimed in claim 21 wherein the volume of the surface recess of the second drum is greater than the volume of the recess of the first drum.

23. A rotor as claimed in claim 21 wherein the surface recess of the first drum is displaced about the axis of rotation of the rotor by approximately 180° relative to the surface recess of the second drum.

24. A rotor as claimed in claim 18 wherein each surface recess is a duct diametrically disposed in the rotor.

* * * * *